US009020708B2

(12) United States Patent
Yamamoto et al.

(10) Patent No.: US 9,020,708 B2
(45) Date of Patent: Apr. 28, 2015

(54) DRIVE CONTROL METHOD OF OPERATING MACHINE

(75) Inventors: Ryo Yamamoto, Kobe (JP); Masahiro Yamada, Kobe (JP); Yoji Yudate, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 13/994,869

(22) PCT Filed: Dec. 7, 2011

(86) PCT No.: PCT/JP2011/006847

§ 371 (c)(1),
(2), (4) Date: Aug. 21, 2013

(87) PCT Pub. No.: WO2012/081201

PCT Pub. Date: Jun. 21, 2012

(65) Prior Publication Data

US 2013/0332036 A1 Dec. 12, 2013

(30) Foreign Application Priority Data

Dec. 17, 2010 (JP) ..... 2010-281745

(51) Int. Cl.

| | |
|---|---|
| ***E02F 9/22*** | (2006.01) |
| ***E02F 9/20*** | (2006.01) |
| ***E02F 9/12*** | (2006.01) |
| ***F15B 11/042*** | (2006.01) |

(52) U.S. Cl.

CPC ..... *E02F 9/2025* (2013.01); *E02F 9/123* (2013.01); *E02F 9/2296* (2013.01); *F15B 11/042* (2013.01); *E02F 9/2095* (2013.01); *E02F 9/2217* (2013.01); *E02F 9/2235* (2013.01); *E02F 9/2285* (2013.01)

(58) Field of Classification Search

USPC ..... 701/36, 50; 60/452, 431, 492, 491, 490; 417/44.2; 477/109, 110, 108; 192/219

See application file for complete search history.

(56) References Cited

U.S. PATENT DOCUMENTS

| | | | | |
|---|---|---|---|---|
| 6,276,449 | B1 * | 8/2001 | Newman | 166/53 |
| 2004/0060205 | A1 | 4/2004 | Yoshino | |
| 2009/0029826 | A1 * | 1/2009 | Eguchi et al. | 477/39 |

(Continued)

FOREIGN PATENT DOCUMENTS

| | | |
|---|---|---|
| JP | A-9-195322 | 7/1997 |
| JP | A-2003-65301 | 3/2003 |

(Continued)

OTHER PUBLICATIONS

International Search Report issued in International Patent Application No. PCT/JP2011/006847 dated Mar. 13, 2012.

*Primary Examiner* — Richard Camby
(74) *Attorney, Agent, or Firm* — Oliff PLC

(57) ABSTRACT

In drive control of an operating machine configured to drive a structure by a hydraulic motor configured to be driven by operating oil supplied from a hydraulic pump through a control valve and an electric motor configured to cooperate with the hydraulic motor, a speed command generated based on a manipulation amount of a remote control valve configured to determine an operation amount of the structure is subjected to speed feedback control performed based on an actual rotation speed of the hydraulic motor and pressure difference feedback control performed based on an operating oil pressure difference between a suction port and discharge port of the hydraulic motor.

11 Claims, 7 Drawing Sheets

(56) References Cited

U.S. PATENT DOCUMENTS

| | | | | |
|---|---|---|---|---|
| 2009/0100831 | A1* | 4/2009 | Sakamoto | 60/492 |
| 2013/0213026 | A1* | 8/2013 | Yamamoto et al. | 60/327 |
| 2013/0332035 | A1* | 12/2013 | Shioiri et al. | 701/50 |

FOREIGN PATENT DOCUMENTS

| | | |
|---|---|---|
| JP | A-2005-290882 | 10/2005 |
| JP | A-2008-63888 | 3/2008 |
| JP | A-2008-291522 | 12/2008 |

* cited by examiner

DRIVE CONTROL METHOD OF OPERATING MACHINE

TECHNICAL FIELD

The present invention relates to a method of controlling a driving device for use in an operating machine, and particularly to a drive control method of an operating machine configured to drive a structure by a hydraulic motor and an electric motor.

BACKGROUND ART

Power machineries, such as hydraulic excavators, cranes, wheel loaders, and bulldozers, (in the present specification and claims, these power machineries (heavy machineries) are collectively called "operating machines") have been used for civil engineering works, construction works, and the like. Taking a hydraulic excavator 100 shown in FIG. 7 as an example, the hydraulic excavator 100 is configured such that: a revolving super structure (structure) 102 is provided on the upper portion of a base carrier 101; and the revolving super structure 102 includes an engine, a driver's seat, an arm 104 having a tip end on which a bucket 103 is provided, a boom 105 coupled to the arm 104, and the like. The boom 105 is configured to be moved up by a boom cylinder 106. Therefore, the revolving super structure 102 is a large heavy structure. By manipulating a remote controller at the driver's seat during operations, the revolving super structure 102 is caused to swing on the upper portion of the base carrier 101. In addition, by driving the boom 105 and the like in a vertical direction, various operations are performed by the bucket 103 provided at the tip end of the awl 104.

Such an operating machine includes a plurality of hydraulic pumps for driving the revolving super structure 102, the boom 105, and the like. The operating machine obtains a high driving force by an operating oil supplied from each hydraulic pump or by causing the operating oils supplied from a plurality of hydraulic pumps to join one another depending on conditions. In recent years, proposed is an operating machine in which the revolving super structure 102 is caused to swing by a driving device including a hydraulic motor and an electric motor.

One example of an operating machine including this type of driving device is an operating machine including a driving device which includes a hydraulic unit having a hydraulic motor as a driving source and an electric unit having an electric motor as a driving source, controls the electric motor by a controller and an inverter at the time of swing, and assists the hydraulic unit by the torque of the electric motor (see PTL 1, for example). According to this operating machine, when the driving device performs steady swing or decelerates, the electric motor is caused to perform a regenerative action, and regenerative electric power is stored in a capacitor. A control unit of the driving device calculates required torque at the time of the swing. When the required torque exceeds a set value, the electric motor outputs necessary torque. To be specific, maximum torque necessary as a whole is secured by causing the electric unit to assist the hydraulic unit. In this case, necessary torque is generated by adjusting the assist amount of the electric unit. The control unit is configured to control the output torque of the electric motor so as to shorten a relief time of a relief valve provided at a hydraulic motor circuit.

Further, another conventional art is a construction machinery including a hybrid driving device having a driving force synthesis mechanism configured to synthesize the driving force of a hydraulic actuator and the driving force of a motor generator. In the construction machinery, a communication valve (bypass valve) is provided for effectively utilizing energy generated at the time of braking, and inertial energy of the revolving super structure is efficiently regenerated as electric energy by the motor generator (see PTL 2, for example). In this conventional art, the relief valve incorporated in the hydraulic motor is used as a setting unit configured to set a ratio between the driving force of the hydraulic actuator and the driving force of the motor generator configured to cooperate with the hydraulic actuator.

Still another conventional art is that: a pressure difference between both ports of the hydraulic actuator is detected; and a torque command is output to the motor generator, provided close to the hydraulic actuator, in accordance with the pressure difference (see PTL 3, for example). In this conventional art, the revolving super structure is configured to be driven by the sum of driving and braking torques of the hydraulic motor and the motor generator. The relief valve configured to control highest driving pressure of the hydraulic motor at the time of driving and stopping is provided such that the ratio of the output torque of the hydraulic motor at the time of the driving becomes larger than that at the time of the braking. The working pressure of the relief valve at the time of the start-up and acceleration is set to be higher than that at the time of the deceleration and stopping.

CITATION LIST

Patent Literature

PTL 1: Japanese Laid-Open Patent Application Publication No. 2005-290882
PTL 2: Japanese Laid-Open Patent Application Publication No. 2008-291522
PTL 3: Japanese Laid-Open Patent Application Publication No. 2008-63888

SUMMARY OF INVENTION

Technical Problem

As the operations of the structure of the operating machine, operations, such as sand digging and loading operations of the hydraulic excavator 100, of exponentially accelerating or decelerating the revolving super structure 102 are frequently performed. Therefore, in order to cause the revolving super structure 102 that is the large heavy structure and an inertial body to swing at a desired speed, a remote control valve is quickly, largely manipulated in many cases.

In the operating machine of PTL 1, flow rate control is performed by causing secondary pressure of the remote control valve to directly act on a pilot port of a control valve. Therefore, at the time of swing acceleration by largely manipulating the remote control valve at the time of swing manipulation, the control valve widely opens, and pressure oil ejected from the hydraulic pump entirely flows into the hydraulic motor circuit. Even if the relief valve having a pressure increase buffer function is used in the hydraulic motor circuit as described above, just a part of the pressure oil is used as power for driving the hydraulic motor until the swing speed of the revolving super structure that is the inertial body reaches a desired swing speed, and the remaining pressure oil is discharged through the relief valve. Therefore, the energy use efficiency decreases. This decrease of the energy use efficiency occurs significantly since a significant energy loss occurs at the time of the swing acceleration at which the energy consumption increases. The decrease of the energy use efficiency as above similarly occurs in a driving device configured to accelerate a structure other than the revolving super structure.

The control unit is configured such that only when a torque required at the time of swing exceeds a required value, a necessary torque is output from the electric motor. Therefore, under an operational condition in which comparatively low torques are required consecutively, a time for the operation of the electric motor may not be adequately secured. Therefore, stored electric energy may not be adequately utilized.

Further, when the control valve is closed at the time of braking, the hydraulic motor circuit becomes a closed circuit. Even if a deceleration torque is assisted by the electric motor, a hydraulic torque is generated, and the relief valve operates. Therefore, inertial energy at the time of deceleration cannot be efficiently recovered as electric energy.

As with PTL 1, in the invention described in PTL 2, the secondary pressure of the remote control valve is caused to directly act on the pilot port of the control valve. Therefore, a large amount of pressure oil is supplied to the control valve at the time of manipulation of the remote control valve. Until the revolving super structure reaches a desired speed, and the hydraulic motor generates a predetermined torque, a large amount of pressure oil is discharged through the relief valve. Thus, the energy loss occurs.

PTL 3 describes an invention in which pressures at a hydraulic oil supply port and outlet port of the hydraulic motor are detected, and operations of a generator motor are controlled. However, PTL 3 does not describe a detailed control method of utilizing the detected pressures to control the amount of pressure oil supplied to the hydraulic motor.

The operating machine, such as the hydraulic excavator, performs a combined operation in which by manipulating a plurality of operating levers at the same time, for example, the revolving super structure 102 is caused to swing by the hydraulic motor, and at the same time, an operation of lifting up sand by the bucket 103 provided at the tip end of the boom 105 is performed by the boom cylinder (hydraulic actuator) 106. In the operating machine configured to perform such a combined operation, a plurality of hydraulic pumps having capacities corresponding to engine power are provided. During the combined operation, the operating oils ejected from the plurality of hydraulic pumps flow to a driven side that requires power, and ejecting pressure of the hydraulic pumps becomes equal to the pressure of the driven side.

However, in the operating machine including a structure, such as the revolving super structure, driven by the hydraulic motor and the electric motor, when the operating oils from the plurality of hydraulic pumps are caused to flow to the hydraulic actuator that temporarily requires high power, the ejecting pressure of the plurality of hydraulic pumps becomes equal to driving pressure of the hydraulic actuator. Therefore, the pressure of the operating oil supplied to the hydraulic motor that drives the structure together with the electric motor also becomes equal to the driving pressure of the hydraulic actuator, that is, becomes pressure inappropriate for a driving condition of the hydraulic motor at that time. On this account, it becomes difficult to efficiently drive the operating machine.

PTLs 1 to 3 do not describe the configuration in which in a state where the operating oil to be supplied to the hydraulic motor that drives the revolving super structure in cooperation with the electric motor is caused to flow to a drive power source of the other structure, the revolving super structure is efficiently driven by the hydraulic motor.

Solution to Problem

Here, an object of the present invention is to provide a drive control method of an operating machine, the method being capable of suppressing the energy loss by controlling the amount of oil supplied to the hydraulic motor in accordance with the manipulation amount of the remote control valve, the rotation speed of the hydraulic motor, and the operating oil pressure difference between a suction port and discharge port of the hydraulic motor.

To achieve the above object, the present invention is a drive control method of an operating machine configured to drive a structure by a hydraulic motor and an electric motor configured to cooperate with the hydraulic motor, the hydraulic motor being configured to be driven by operating oil supplied from a hydraulic pump through a control valve, the hydraulic pump being configured to be able to change an ejection flow rate by control of a tilting angle of the hydraulic pump, the method including: causing a speed command, generated based on a manipulation amount of a remote control valve configured to determine an operation amount of the structure, to be subjected to speed feedback control, performed based on an actual rotation speed of the hydraulic motor, and pressure difference feedback control, performed based on an operating oil pressure difference between a suction port and discharge port of the hydraulic motor, to generate an opening position command such that the operating oil, the amount of which is necessary at the actual rotation speed of the hydraulic motor, is ejected; and controlling an opening position of the control valve. In the present specification and claims, examples of the "structure" include a revolving super structure configured to swing and a boom configured to move linearly. In addition, the "operation amount of the structure" includes all the operation amounts, such as "the operating speed and operation amount of the structure".

With this, the opening position of the control valve is controlled such that the operating oil is ejected, the amount of which is appropriate for obtaining, by the hydraulic motor, drive torque corresponding to the difference between the manipulation amount of the remote control valve and the actual rotation speed of the hydraulic motor and also appropriate for the actual rotation speed of the hydraulic motor. Therefore, the amount of operating oil supplied from the hydraulic pump to the hydraulic motor can be adjusted to the amount appropriate for the actual rotation speed and necessary to obtain the drive torque corresponding to the difference between the manipulation amount of the remote control valve and the actual rotation speed of the hydraulic motor. Thus, the energy efficiency can be improved.

The drive control method may include causing the opening position command to be subjected to flow rate compensation such that the operating oil, the amount of which is appropriate for the actual rotation speed of the hydraulic motor, is supplied, the flow rate compensation being performed in such a manner that a speed signal generated based on the actual rotation speed is added through a control gain to a signal obtained by the pressure difference feedback control. With this, the opening position command of the control valve generated by the pressure difference feedback control is subjected to the flow rate compensation such that the oil, the amount of which is necessary at the actual rotation speed, is obtained. Therefore, the opening position of the control valve can be controlled such that the necessary oil amount corresponds to the changing actual rotation speed. Thus, the responsiveness can be improved.

The drive control method may include performing pressure increase compensation by providing a minor loop between the opening position command having been subjected to the flow rate compensation and a pressure difference command to which the pressure difference feedback signal is input, the minor loop being configured to perform feedback of a difference of the opening position command. With this, the gain in the high frequency range of the opening position command having been subjected to the flow rate compensation is reduced by the feedback control of the minor loop. Thus, the stability of the pressure control can be improved.

The drive control method may be designed such that: the hydraulic pump is a first hydraulic pump; the control valve is a first control valve; the structure is a first structure; in addition to the first structure, a second structure configured to be driven by the operating oil supplied from a second hydraulic pump through a second control valve is included in the operating machine; and the operating oil supplied from the first hydraulic pump is caused to join the operating oil used to drive the second structure, and the method may include: causing the speed command, generated based on the manipulation amount of the remote control valve configured to determine the operation amount of the first structure, to be subjected to the speed feedback control, performed based on the actual rotation speed of the hydraulic motor, and the pressure difference feedback control, performed based on the operating oil pressure difference between the suction port and discharge port of the hydraulic motor, to generate a tilting angle command of the hydraulic pump such that the operating oil, the amount of which is necessary at the actual rotation speed of the hydraulic motor, is ejected; causing the tilting angle command to be subjected to the flow rate compensation such that the operating oil, the amount of which is appropriate for the actual rotation speed of the hydraulic motor, is supplied, the flow rate compensation being performed in such a manner that the speed signal generated based on the actual rotation speed is added through the control gain to the signal obtained by the pressure difference feedback control; comparing a signal obtained by the flow rate compensation and the other command in the operating machine; selecting a maximum value from the signal obtained by the flow rate compensation and the other command in the operating machine; and controlling tilting of the hydraulic pump by using a signal of the maximum value as the tilting angle command.

As above, both the opening position control of the control valve and the tilting control of the hydraulic pump are performed. With this, in the operating machine including the first structure driven by the hydraulic motor and electric motor driven by the operating oil supplied from the first hydraulic pump through the first control valve and the second structure driven by the operating oil supplied from the second hydraulic pump through the second control valve and configured such that the operating oil of the first hydraulic pump is caused to join the operating oil for driving the second structure, the flow rate control can be performed such that the tilting angle command of the first hydraulic pump is set to the tilting angle command that satisfies the maximum value in the operating machine. In addition, by reducing the opening position of the first control valve by the above opening position control, the ejecting pressure of the first hydraulic pump necessary for the joining can be secured. Further, the opening position of the control valve can be set to the opening position appropriate for the actual rotation speed of the hydraulic motor and necessary to obtain the drive torque corresponding to the difference between the manipulation amount of the remote control valve and the actual rotation speed of the hydraulic motor.

In the case of causing only the first structure to swing by the hydraulic motor and the electric motor, a control operation may be performed, in which: without performing the opening position control of the first control valve, the opening position of the first control valve is set to a maximum opening position such that the pressure loss is minimized; and the tilting angle control of the first hydraulic pump is performed. As above, by switching the opening position control of the control valve, the operation in which the pressure loss is small can be performed.

The drive control method may include at the time of initial acceleration of the structure, generating the opening position command of the control valve such that a shortfall that is torque obtained by subtracting drive torque, which is able to be output by the electric motor, from torque necessary for the acceleration of the structure is compensated by drive torque of the hydraulic motor. With this, at the time of initial acceleration of the structure that is the inertial body, the drive control is performed while calculating respective energies such that the torque necessary to accelerate the structure is obtained from the drive torque that can be output by the electric motor based on the voltage of the capacitor, and the shortfall of the drive torque of the electric motor is compensated by the drive torque of the hydraulic motor. Therefore, the use efficiency of the stored electric energy can be improved. In addition, the operating oil to the hydraulic motor is supplied through the control valve whose opening position is controlled such that the shortfall of the drive torque of the electric motor is compensated. On this account, the driving with high energy efficiency can be performed.

A drive control method of an operating machine according to the present invention is a drive control method of an operating machine configured to drive a first structure by a hydraulic motor and an electric motor configured to cooperate with the hydraulic motor, the hydraulic motor being configured to be driven by operating oil supplied from a first hydraulic pump through a first control valve, the first hydraulic pump being configured to be able to change an ejection flow rate by control of a tilting angle of the first hydraulic pump, wherein: in addition to the first structure, a second structure configured to be driven by the operating oil supplied from a second hydraulic pump through a second control valve is included in the operating machine; and the operating oil of the first hydraulic pump is caused to join the operating oil used to drive the second structure, the method including: causing a speed command, generated based on a manipulation amount of a remote control valve configured to determine an operation amount of the first structure, to be subjected to speed feedback control, performed based on an actual rotation speed of the hydraulic motor, second pump pressure feedback control, performed by feedback of actual ejecting pressure of the second hydraulic pump, and pressure difference feedback control, performed based on an operating oil pressure difference between a suction port and discharge port of the hydraulic motor, to generate a swing tilting angle command of the first hydraulic pump such that the operating oil, the amount of which is necessary at the actual rotation speed of the hydraulic motor, is ejected; selecting a maximum value from the swing tilting angle command of the first hydraulic pump and a tilting angle command of the second hydraulic pump; and controlling the tilting angle of the first hydraulic pump.

With this, in the operating machine including the first structure driven by the hydraulic motor and electric motor driven by the operating oil supplied from the first hydraulic pump and the second structure driven by the operating oil supplied from the second hydraulic pump and configured such that the operating oil of the first hydraulic pump is caused to join the operating oil for driving the second structure, the feedback control of the tilting angle command of the first hydraulic pump is performed in accordance with the actual ejecting pressure of the second hydraulic pump. Thus, the operating oil ejected from the first hydraulic pump can be caused to stably join the operating oil ejected from the second hydraulic pump.

The second pump pressure feedback control may be performed as join compensation in which: a hydraulic motor torque command is obtained by subtracting an electric motor torque from a drive torque command having been subjected to the speed feedback control; and the actual ejecting pressure of the second hydraulic pump is fed back to the hydraulic motor torque command. With this, the tilting angle command of the first hydraulic pump generated so as to obtain the hydraulic motor torque except for the electric motor torque is corrected by the ejecting pressure of the second hydraulic pump. Therefore, the feedback control of the tilting angle command of the first hydraulic pump can be more properly performed in accordance with the actual ejecting pressure of the second hydraulic pump.

The drive control method may include: subtracting the hydraulic motor torque command having been subjected to the join compensation from the drive torque command having been subjected to the speed feedback control, to obtain a torque command difference; and calculating a necessary electric motor torque command from the torque command difference and energy, by which the electric motor is able to be driven, to compensate for a shortfall of the torque of the hydraulic motor by the electric motor. With this, in the operating machine including a plurality of structures driven by a plurality of hydraulic pumps, the shortfall of the drive torque of the hydraulic motor for the swinging of the revolving super structure is compensated by the electric motor. Therefore, the driving with high energy efficiency can be performed by efficiently using the stored electric energy in accordance with the drive torque of the hydraulic motor.

As compared to a case where the second structure is driven by causing the operating oil of the first hydraulic pump to join the operating oil ejected from the second hydraulic pump while causing the first structure to swing only by the hydraulic motor, the hydraulic motor torque is the same torque as above, and the drive torque can be increased by the assist of the electric motor torque. Therefore, the time for the swing operation can be shortened.

The drive control method may include: adding back pressure of the hydraulic motor to a pressure difference command of the first hydraulic pump generated based on the hydraulic motor torque command having been subjected to the join compensation, to obtain a relief pressure command of a hydraulic motor circuit; and setting the relief pressure command as relief pressure of a solenoid-operated relief valve in a circuit located upstream of the hydraulic motor. With this, the control pressure of the solenoid-operated relief valve can be prevented from being set to be lower than the pressure necessary for the system. The set value of the solenoid-operated relief valve can be adjusted such that the operation oil is not discharged when the pressure is equal to or lower than the pressure of the operating oil ejected from the first hydraulic pump. Thus, the pressure of the operating oil for driving the second structure can be stably maintained in the hydraulic motor circuit.

The drive control method may include causing the swing tilting angle command of the first hydraulic pump to be subjected to flow rate compensation such that the operating oil, the amount of which is appropriate for the actual rotation speed of the hydraulic motor, is supplied, the flow rate compensation being performed in such a manner that a speed signal generated based on the actual rotation speed is added through a control gain to a signal obtained by the pressure difference feedback control. With this, the flow rate compensation is performed with respect to the final swing tilting angle command of the first hydraulic pump such that the amount of oil necessary at the actual rotation speed of the hydraulic motor is obtained. Therefore, the tilting control of the first hydraulic pump can be performed such that the necessary oil amount corresponds to the changing actual rotation speed.

The drive control method may include performing pressure increase compensation by providing a minor loop between the swing tilting angle command having been subjected to the flow rate compensation and a pressure difference command to which the pressure difference feedback signal is input, the minor loop being configured to perform feedback of a difference of the swing tilting angle command. With this, the gain in the high frequency range of the swing tilting angle command having been subjected to the flow rate compensation is reduced by the feedback control of the minor loop. Thus, the stability of the pressure control can be improved.

Advantageous Effects of Invention

According to the present invention, the opening position control of the control valve or the tilting control of the hydraulic pump are performed such that the amount of hydraulic oil for driving the hydraulic motor is optimized in accordance with the manipulation amount of the remote control valve. Therefore, the energy efficiency when driving the structure by the hydraulic motor can be improved.

In the operating machine including a hydraulic pump configured to supply the operating oil to a structure driven by the electric motor and the hydraulic motor and a structure driven by the hydraulic actuator, the operating oil of the hydraulic motor is caused to join the operating oil of the hydraulic actuator, and the operating oil corresponding to the manipulation amount of the remote control valve is supplied to the hydraulic actuator and the hydraulic motor. Thus, a plurality of structures can be efficiently driven.

DESCRIPTION OF EMBODIMENTS

Hereinafter, embodiments of the present invention will be explained based on the drawings. In the following embodiments, a revolving super structure of a hydraulic excavator (hereinafter simply referred to as a "revolving super structure") will be explained as an example of a first structure of an operating machine, and a boom driven by a hydraulic actuator will be explained as a second structure of the operating machine. In addition, a pump configured to drive a hydraulic motor for operating the first structure is a first hydraulic pump, and a pump configured to drive a hydraulic actuator for operating the second structure is a second hydraulic pump.

Figure 1:
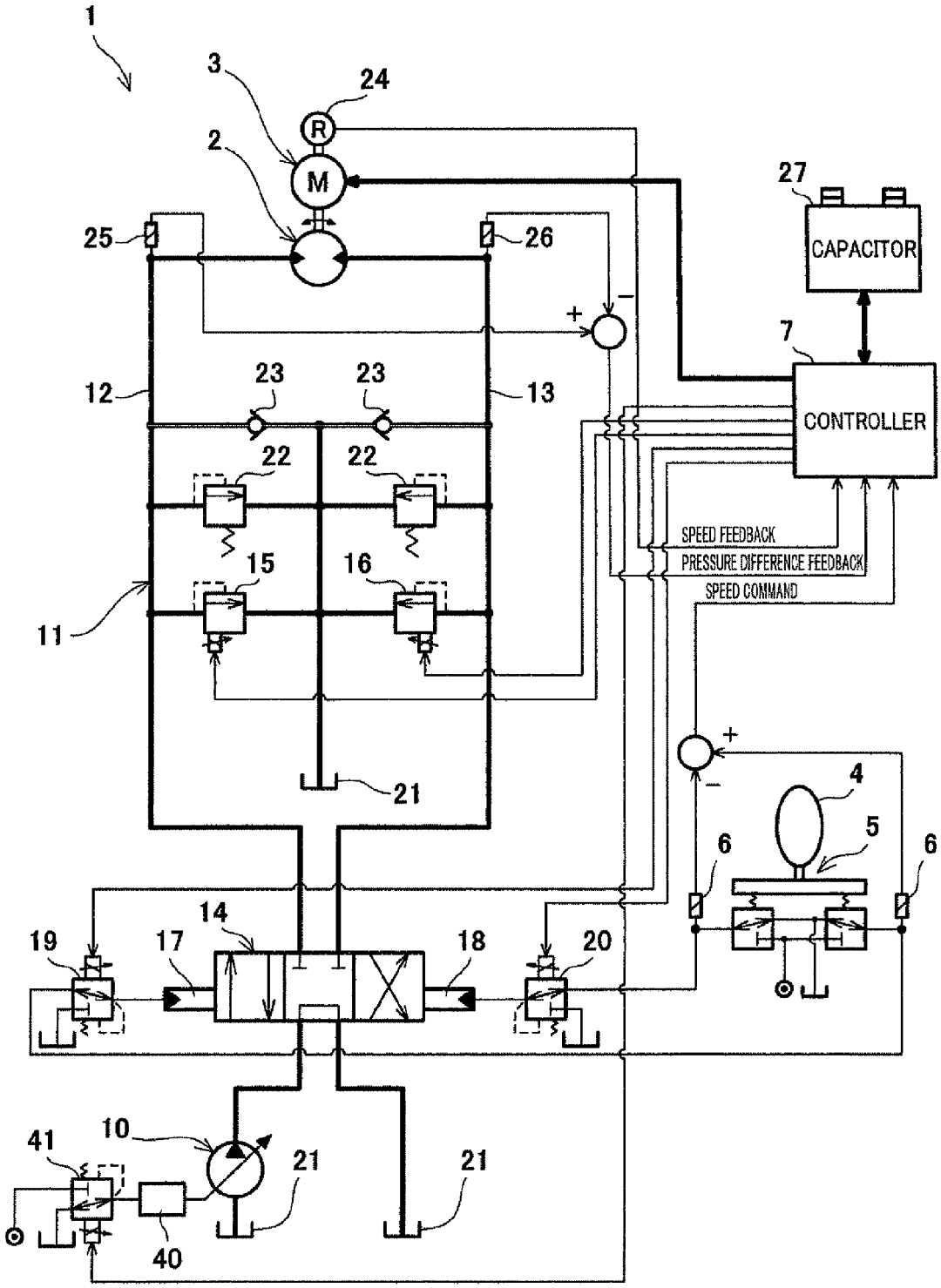
FIG. 1 is a hydraulic circuit diagram showing a first hydraulic pump system configured to drive a hydraulic motor that cooperates with an electric motor of a drive controller according to the present invention.
Figure 7:
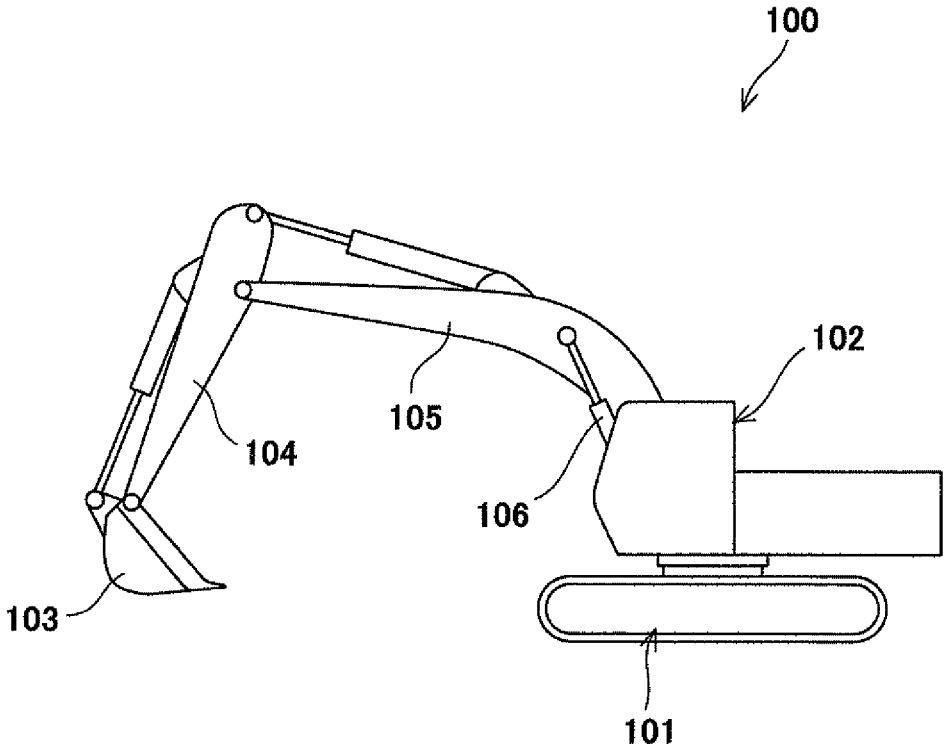
FIG. 7 is a side view showing a hydraulic excavator that is one example of an operating machine.

As shown in FIG. 1, a drive controller 1 configured to drive the revolving super structure (first structure; reference sign 102 in FIG. 7) is configured to cause the revolving super structure to swing by a hydraulic motor 2 and an electric motor 3 in cooperation. In addition, the drive controller 1 is configured such that when the hydraulic motor 2 decelerates, inertial energy (kinetic energy) of the hydraulic motor 2 is converted into electric energy by a regeneration function of the electric motor 3, and the obtained energy is recovered. Since the regeneration function of the electric motor 3 which is caused to perform a regenerative action as a power generator is a known technology, a detailed explanation thereof is omitted.

The drive controller 1 includes a first remote control valve 5 (swing remote controller) configured to determine an operation amount of the revolving super structure. The operation amount includes a swing direction, swing speed, and the like of the revolving super structure. The first remote control valve 5 includes an inclination handle 4 configured to determine the swing direction of the revolving super structure. The swing direction, speed, and acceleration rate of the revolving super structure are determined by the inclination direction, angle, speed, and the like of the inclination handle 4. The first remote control valve 5 is provided with pressure sensors 6 configured to detect secondary pressure corresponding to a manipulation amount of the first remote control valve 5. A pressure difference between left and right ports of the remote control valve 5 is detected by the pressure sensors 6 to be input to a controller 7 as a speed command (rotation speed command) for causing the revolving super structure to rotate. When a positive signal corresponds to positive rotation, a negative signal corresponds to negative rotation.

The hydraulic motor 2 is driven by operating oil ejected by a first hydraulic pump 10. The hydraulic motor 2 is connected to a hydraulic motor circuit 11 configured to suction the operating oil from the first hydraulic pump 10 and discharge the operating oil. Oil passages 12 and 13 connected to the suction port and discharge port of the hydraulic motor 2 in the hydraulic motor circuit 11 are connected through a first control valve 14. The suction port and discharge port of the hydraulic motor 2 switch in accordance with a rotational direction of the hydraulic motor 2.

Solenoid-operated relief valves 15 and 16 are provided between the oil passages 12 and 13 of the hydraulic motor circuit 11. When the hydraulic motor 2 decelerates, the oil passages 12 and 13 are caused to communicate with each other through the solenoid-operated relief valves 15 and 16. With this, the loss generated on the discharge side of the hydraulic motor 2 is avoided. Since the flow direction of the operating oil is different between when the hydraulic motor 2 performs the positive rotation and when the hydraulic motor 2 performs the negative rotation, the solenoid-operated relief valves 15 and 16 are provided such that the operating oil can be discharged from the oil passages 12 and 13.

Further, relief valves 22 and check valves 23 are provided between the oil passages 12 and 13. Each of the relief valves 22 operates so as to release the operating oil to a tank 21 when the pressure of the operating oil exceeds pressure at the time of ordinary use. Each of the check valves 23 suctions the oil from the tank 21 if the amount of oil decreases when the oil is circulating in the oil passages 12 and 13.

In the present embodiment, solenoid-operated proportional reducing valves 19 and 20 are respectively provided at pilot ports 17 and 18 of swing sections of the first control valve 14. The secondary pressure of the first remote control valve 5 is introduced to the solenoid-operated proportional reducing valves 19 and 20 as primary pressure, and the controller 7 can control the secondary pressure of the solenoid-operated proportional reducing valves 19 and 20. By these solenoid-operated proportional reducing valves 19 and 20, the pilot ports 17 and 18 of the first control valve 14 can be controlled with a high degree of accuracy. As above, the opening position of the first control valve 14 is controlled by the solenoid-operated proportional reducing valves 19 and 20 based on an opening position command output from the controller 7, and the first control valve 14 is controlled such that the operating oil, the amount of which is necessary at the actual rotation speed of the hydraulic motor 2, is supplied in accordance with the speed command output from the first remote control valve 5. In the present embodiment, inverse proportional solenoid-operated reducing valves are used as the solenoid-operated proportional reducing valves 19 and 20.

Further, pressure sensors 25 and 26 are respectively provided at the suction port and discharge port of the hydraulic motor 2. A difference between the pressure detected by the pressure sensor 25 and the pressure detected by the pressure sensor 26 is input to the controller 7 as pressure difference feedback. By the pressure difference between the suction port and discharge port of the hydraulic motor 2, the torque generated by the hydraulic motor 2 is estimated in the controller 7 (in the case of the negative signal, counter torque).

The electric motor 3 is connected to a capacitor 27 via the controller 7. The capacitor 27 is configured to store electric power for driving the electric motor 3. The capacitor 27 supplies and receives the electric power to and from the electric motor 3 via the controller 7. When the hydraulic motor 2 is accelerating to cause the revolving super structure to rotate, the capacitor 27 discharges and supplies the electric power to the electric motor 3 which cooperates with the hydraulic motor 2. When the hydraulic motor 2 is decelerating, the capacitor 27 stores regenerative electric power obtained by causing the electric motor 3 to perform the regenerative action so as to brake the hydraulic motor 2. As above, when the hydraulic motor 2 accelerates, the controller 7 outputs a rotation command to the electric motor 3 which cooperates with the hydraulic motor 2. When the hydraulic motor 2 decelerates, the controller 7 outputs a regeneration command to the electric motor 3 so as to brake the hydraulic motor 2.

Further, the electric motor 3 is provided with a rotation speed sensor 24. The actual rotation speed detected by the rotation speed sensor 24 is input to the controller 7 as speed feedback. In accordance with this speed feedback, an acceleration rate is obtained in the controller 7 based on the difference between the speed command (rotation speed command) output from the first remote control valve 5 and the actual rotation speed.

A solenoid-operated proportional reducing valve 41 is provided at a tilting angle adjusting port 40 configured to control the tilting angle of the first hydraulic pump 10. A solenoid current of the solenoid-operated proportional reducing valve 41 is controlled by a signal output from the controller 7. Thus, the tilting angle of the first hydraulic pump 10 is controlled. As above, the tilting angle of the first hydraulic pump 10 is controlled by the solenoid-operated proportional reducing valve 41 based on a tilting angle command output from the controller 7, and the operating oil, the amount of which is necessary at the actual rotation speed of the hydraulic motor 2, is ejected in accordance with the speed command of the first remote control valve 5.

As specific control by the controller 7, to obtain torque set in the electric motor 3 and the hydraulic motor 2, the electric motor 3 and the hydraulic motor 2 are controlled based on the speed command (rotation speed signal) output from the first remote control valve 5, the pressure difference feedback (torque signal) based on a pressure difference signal of the hydraulic motor 2, and the speed feedback (actual rotation speed) based on the rotation speed signal of the electric motor 3. To be specific, the electric motor 3 is caused to rotate, and in order to compensate for the shortfall of the torque of the electric motor 3, the opening position command is transmitted to the solenoid-operated proportional reducing valves 19 and 20 of the first control valve 14, or the tilting angle command is transmitted to the solenoid-operated proportional reducing valve 41 of the first hydraulic pump 10. Thus, the hydraulic motor 2 is rotated by the operating oil supplied from the first hydraulic pump 10 through the first control valve 14.

In addition, when the first remote control valve 5 is manipulated, and the controller 7 determines that the revolving super structure accelerates, and the electric energy capable of driving the electric motor 3 is being stored in the capacitor 27, the electric motor 3 is preferentially driven by this electric energy. In this case, the shortfall of the torque is compensated by the hydraulic motor 2 controlled as above. In this period, the solenoid-operated relief valves 15 and 16 do not basically operate. However, the solenoid-operated relief valves 15 and 16 may be subsidiarily used to compensate for a pressure control performance obtained by the control of the opening position of the first control valve 14 or the control of the tilting angle of the first hydraulic pump 10.

As above, to obtain the torque corresponding to the shortfall calculated by subtracting the torque of the electric motor 3 from swing drive torque corresponding to the manipulation amount of the first remote control valve 5, the controller 7 controls the opening position of the first control valve 14 or the tilting angle of the first hydraulic pump 10 to perform the pressure control for the hydraulic motor 2 in the drive controller 1. The pressure control by the first control valve 14 is performed in such a manner that the opening position of the first control valve 14 is controlled by the solenoid-operated proportional reducing valves 19 and 20. With this, the amount of hydraulic oil supplied from the first hydraulic pump 10 to the hydraulic motor 2 is controlled with a high degree of accuracy. At this time, the tilting of the first hydraulic pump is controlled such that: a swing tilting angle command of the first hydraulic pump 10 and the other command in the operating machine are compared with each other; the maximum value is selected; and a signal of the maximum value is used as the tilting angle command. In a case where only the first structure is caused to swing by the hydraulic motor 2 and the electric motor 3, the pressure control is performed by the control of the tilting angle of the first hydraulic pump 10, not by the control of the opening position of the first control valve 14. With this, the amount of hydraulic oil supplied from the first hydraulic pump 10 to the hydraulic motor 2 is controlled with a high degree of accuracy. At this time, the opening position of the first control valve 14 is controlled such that the pressure loss is minimized. This opening position is basically set to a maximum opening position.

The distribution of the torque of the electric motor 3 and the torque of the hydraulic motor 2 can be changed by controlling the opening position of the first control valve 14 or the tilting angle of the first hydraulic pump 10. For example, if the stored energy of the capacitor 27 has become equal to or lower than a prescribed value, the torque of the electric motor 3 is gradually decreased, and at the same time, the torque of the hydraulic motor 2 is increased. Thus, the switching from the electric motor 3 to the hydraulic motor 2 can be performed smoothly in a shockless manner. Finally, the opening position of the first control valve 14 or the tilting angle of the first hydraulic pump 10 is set to obtain the necessary oil amount determined by the rotation speed command output from the first remote control valve 5. Details will be described later. The distribution of the torque of the electric motor 3 and the torque of the hydraulic motor 2 is preset to a ratio by which the energy utilization ratio becomes most preferable. Then, the distribution is changed in accordance with state changes (such as the stored energy of the capacitor 27 being equal to or lower than the prescribed value) related to the torque of the electric motor 3 and the torque of the hydraulic motor 2 such that the total of the torque of the electric motor 3 and the torque of the hydraulic motor 2 becomes the necessary swing drive torque.

In contrast, when the first remote control valve 5 is manipulated, and the controller 7 determines that the revolving super structure decelerates, the electric motor 3 is caused to perform the regenerative action, and the regenerative electric power obtained by converting the inertial energy into the electric energy is stored in the capacitor 27. At this time, the solenoid-operated relief valve 15 or 16 on the brake side is set to an unloaded state, and the operating oil is caused to circulate. In addition, the tilting angle of the first hydraulic pump 10 is set to minimum, and the first control valve 14 is completely closed. Thus, the oil ejected from the first hydraulic pump 10 is entirely supplied to the tank 21 through the first control valve 14. As a result, the consumption energy is minimized.

Further, in a case where it is determined that the entire inertial energy cannot be recovered by the electric motor 3 (for example, in a case where brake torque to be generated by the electric motor 3 has exceeded an acceptable value or in a case where voltage and current control values of the capacitor 27 have exceeded acceptable values), set pressure of the solenoid-operated relief valve 15 or 16 on the brake side is adjusted to increase resistance in the oil passages 12 and 13. With this, the shortfall of the brake torque is generated by the hydraulic motor 2.

As above, at the time of the acceleration, the necessary generated torque of the hydraulic motor 2 is controlled by the amount of operating oil supplied by adjusting the opening position of the first control valve 14 or the tilting angle of the first hydraulic pump 10, and the solenoid-operated relief valve 15 or 16 does not operate in principle. At the time of the deceleration, the solenoid-operated relief valve 15 or 16 on the brake side is set to the unloaded state, and the operating oil is caused to circulate. In addition, the entire amount of deceleration energy is recovered in the capacitor 27 in principle by using the electric motor.

Figure 2:
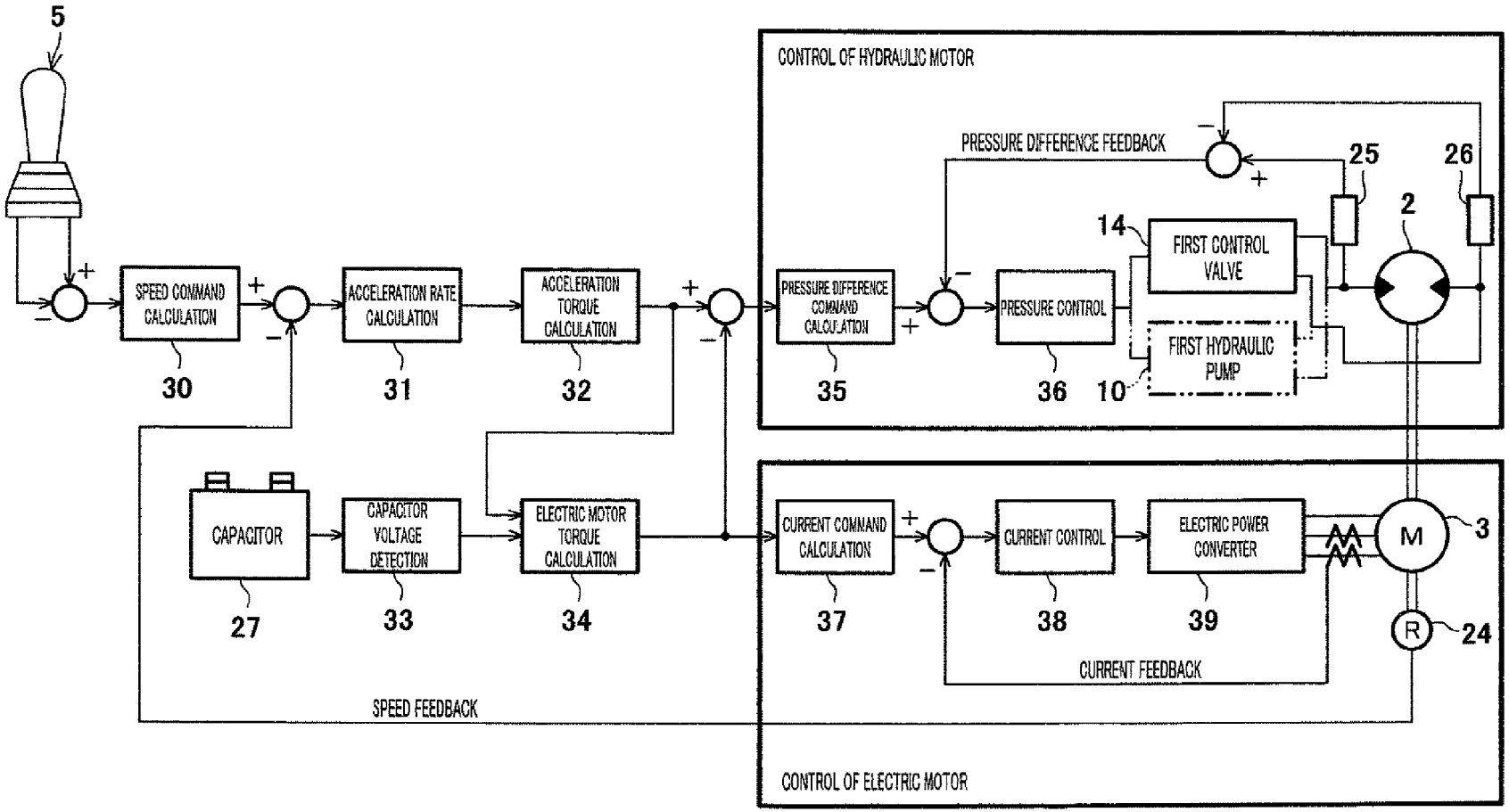
FIG. 2 is a control block diagram of the first hydraulic pump system of the drive controller shown in FIG. 1.

As shown in FIG. 2, in the control block diagram of the drive controller 1, from the inclination direction and manipulation amount of the first remote control valve 5, the speed of the revolving super structure is calculated by a speed command calculation 30. Then, based on the difference between the above speed and the speed feedback output from the rotation speed sensor 24 provided at the electric motor 3, a necessary acceleration rate is calculated by an acceleration rate calculation 31. Next, an acceleration torque of the acceleration rate is calculated by an acceleration torque calculation 32.

Moreover, the voltage of the capacitor 27 is detected by a capacitor voltage detection 33. Based on the detected voltage, the entire torque calculated by the acceleration torque calculation 32, and the like, the torque which can be output by the electric motor 3 is calculated by an electric motor torque calculation 34. The obtained torque which can be output by the electric motor 3 is subtracted from the entire torque calculated by the acceleration torque calculation 32, and the obtained torque is used as the necessary torque of the hydraulic motor 2. In a case where the necessary torque of the hydraulic motor 2 requires a limitation (for example, in a case where the pressure of the suction port of the hydraulic motor 2 needs to be set to a certain value or higher), the torque to be output by the electric motor 3 may be calculated by subtracting the necessary torque of the hydraulic motor 2 from the entire torque.

Regarding the control of the hydraulic motor 2, the necessary torque of the hydraulic motor 2 is subjected to a pressure difference command calculation 35, and the obtained pressure difference command is compared with the pressure difference feedback output from the pressure sensors 25 and 26 configured to detect the pressures at the suction and discharge ports of the hydraulic motor 2. After that, the obtained signal is subjected to a pressure control 36, and the flow rate control is performed by the first control valve 14 or the first hydraulic pump 10. With this, the operating oil, the amount which is an amount by which the hydraulic motor 2 can output the torque except for the output torque of the electric motor 3, is supplied to the hydraulic motor 2, and the hydraulic motor 2 is driven. In the present embodiment, the flow rate control by the first control valve 14 is performed by the solenoid-operated proportional reducing valves 19 and 20, or the flow rate control by the first hydraulic pump 10 is performed by the solenoid-operated proportional reducing valve 41, so that the flow rate control can be performed with a high degree of accuracy.

Further, in FIG. 2, a solid line denotes the control of the flow rate of the operating oil supplied to the hydraulic motor 2 by the flow rate control of the first control valve 14, and a chain double-dashed line denotes the control of the flow rate by the tilting control of the first hydraulic pump 10. In Embodiment 1 described below, the flow rate control by both the first control valve 14 and the first hydraulic pump 10 is performed. In Embodiment 2 described below, the flow rate control by the tilting control of the first hydraulic pump 10 is performed. Details will be described later.

Regarding the control of the electric motor 3, a current is calculated by a current command calculation 37 such that the torque calculated by the electric motor torque calculation 34 is output. This calculation result is compared with the feedback of the current supplied to the electric motor 3. After that, the obtained signal is subjected to a current control 38, and an electric power converter 39 is controlled. Thus, the electric motor 3 is driven. The driving of the electric motor 3 is detected by the rotation speed sensor 24, and the speed feedback is fed back to the calculation result of the speed command calculation 30.

Next, one example of an operation sequence by the drive controller 1 will be explained based on FIG. 3. The operation sequence shows time changes of the speed command output by the first remote control valve 5, the speed feedback of the revolving super structure, the torque of the electric motor 3, a suction-discharge pressure difference torque of the hydraulic motor 2, and the total torque of the electric motor 3 and the hydraulic motor 2.

Figure 3:
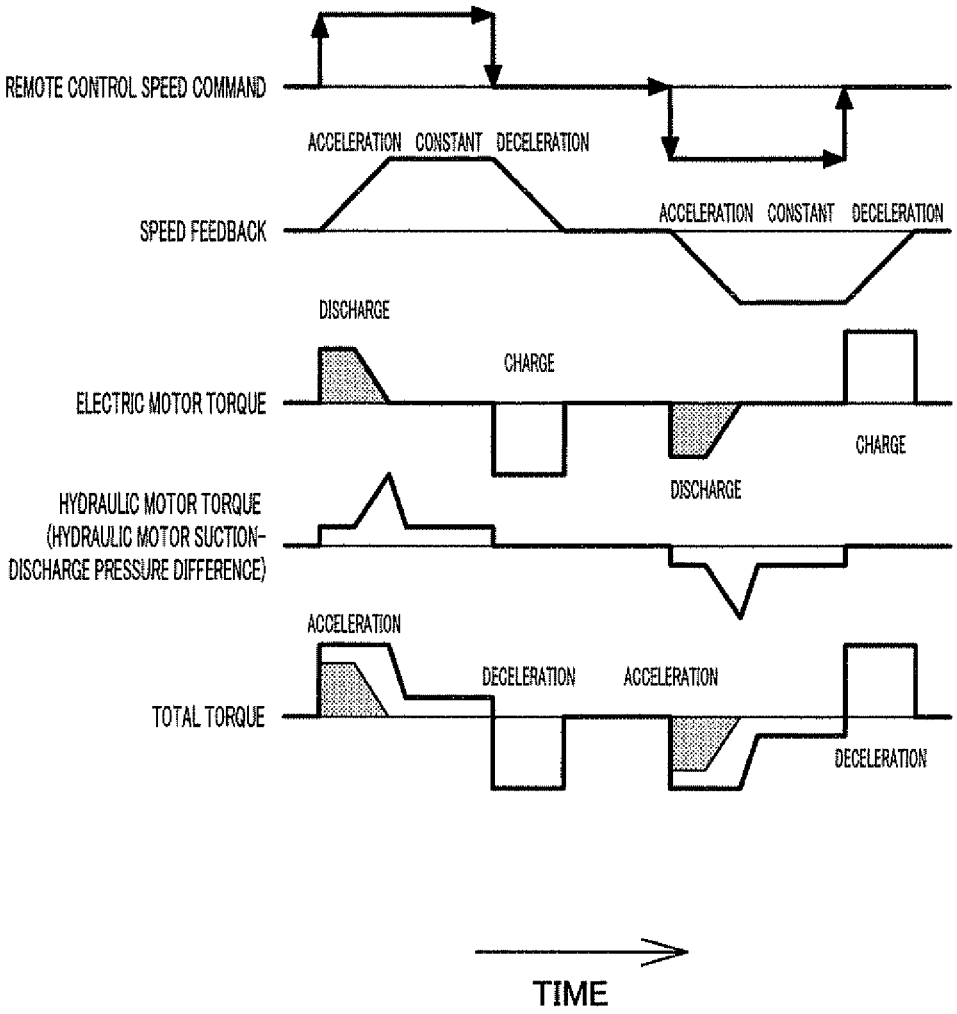
FIG. 3 is a drive sequence diagram of a revolving super structure of the drive controller shown in FIG. 1.

In the example shown in FIG. 3, the first remote control valve 5 is inclined to one side to cause the revolving super structure to "accelerate" and swing at "constant speed" in one direction as shown by the speed feedback. After that, the first remote control valve 5 is returned to neutral to cause the revolving super structure to "decelerate". Then, the first remote control valve 5 is inclined to the other side to cause the revolving super structure to "accelerate", swing at "constant speed", and "decelerate" in the other direction.

When the first remote control valve 5 is manipulated to output the speed command corresponding to an upper direction shown in FIG. 3 (corresponding to the swing in one direction), the electric motor 3 is rotated to generate predetermined torque as the torque for causing the revolving super structure that is the inertial body to rotate. Thus, the capacitor 27 discharges the electric power, and the hydraulic motor 2 is driven so as to compensate for the shortfall of the torque of the electric motor 3. As above, the electric motor 3 and the hydraulic motor 2 are driven such that high synthetic torque for causing the revolving super structure that is the inertial body to accelerate at the time of the start of the swing is obtained by the total of the torque of the electric motor and the torque of the hydraulic motor. To be specific, the output of the electric motor 3 is utilized to obtain the maximum energy saving effect when starting swinging the revolving super structure which is in a stop state, and the shortfall is compensated by the hydraulic motor 2. When the revolving super structure swings at constant speed, low swing torque is obtained only by the hydraulic motor 2. When the revolving super structure decelerates, the substantially entire amount of inertial energy is efficiently recovered as the electric energy by the regenerative action of the electric motor 3, and the electric energy is stored in the capacitor 27.

FIG. 3 also shows that after the above operations, the first remote control valve 5 is manipulated in the opposite direction. However, actions other than the generation of the torque in the opposite direction are the same as the above actions, explanations thereof are omitted.

As above, according to the drive controller 1, the shortfall that is the torque obtained by subtracting the torque, which can be generated by the electric motor 3, from the entire torque that is based on the manipulation amount of the first remote control valve 5 is generated by the hydraulic motor 2. In this case, the amount of operating oil for driving the hydraulic motor 2 is adjusted by controlling the opening position of the first control valve 14 or the tilting angle of the first hydraulic pump 10. Therefore, the efficiency of the energy for driving the revolving super structure can be improved by the electric motor 3 and the hydraulic motor 2. In addition, since the swing control is performed while monitoring the voltage of the capacitor 27 and calculating the energy that can be supplied to the electric motor 3, the use efficiency of the stored energy can be improved.

When the hydraulic motor 2 decelerates, the pressure loss generated on the discharge side of the hydraulic motor 2 can be avoided by opening the solenoid-operated relief valve 15 or 16, and the substantially entire amount of inertial energy of the revolving super structure can be recovered as the electric energy by the regenerative action of the electric motor 3. Therefore, the drive controller 1 can be operated with high energy efficiency.

Further, to prevent swing-back caused by, for example, an oil compression effect in this type of hydraulic drive when stopping the revolving super structure, the rotation speed of the electric motor 3 is observed, and the torque of the electric motor 3 is controlled at the time of the stop. Thus, riding quality can be improved. Since the torque of the electric motor 3 and the torque of the hydraulic motor 2 are individually controlled, the swing feeling can be set freely.

Figure 4:
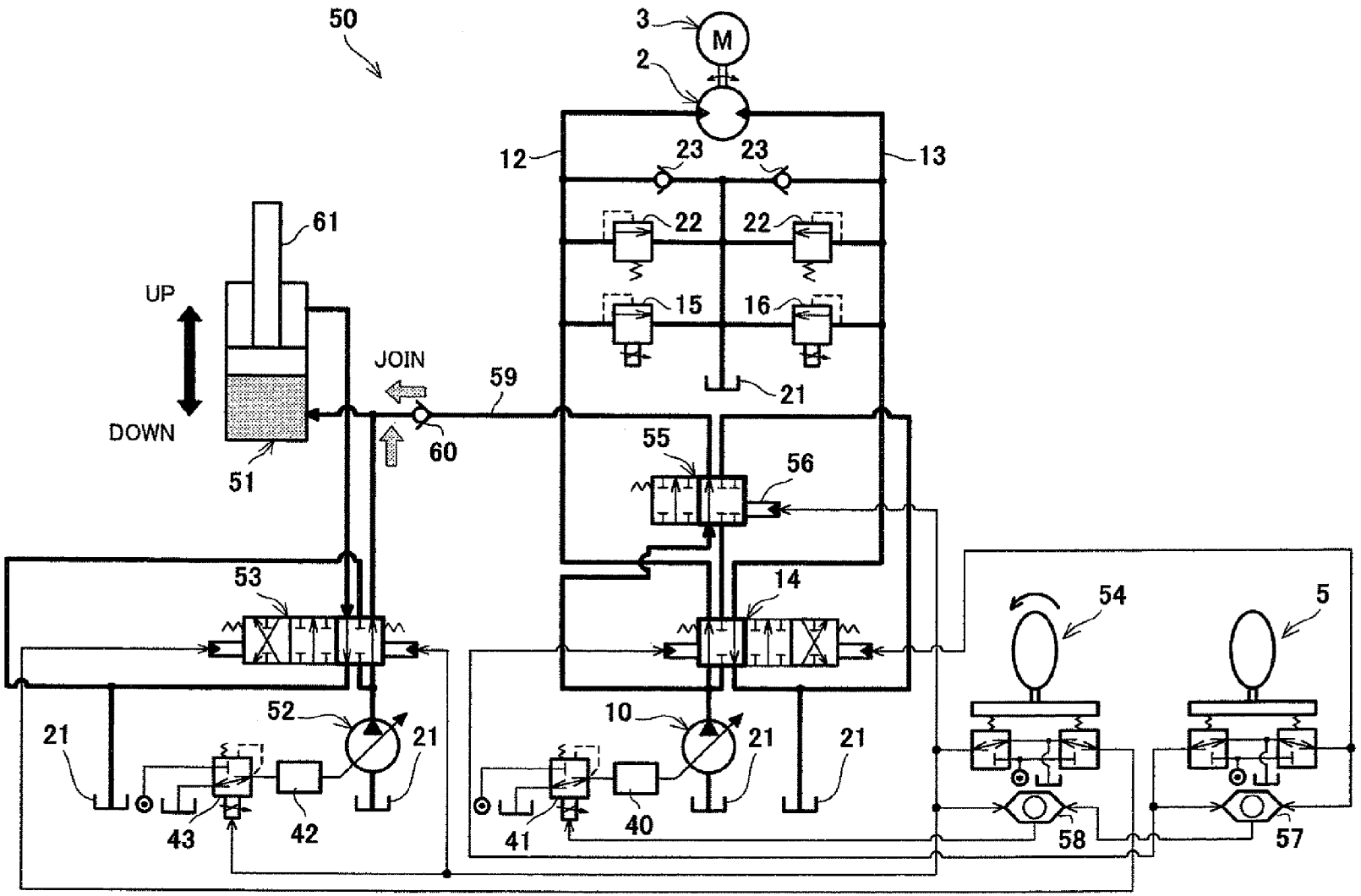
FIG. 4 is a hydraulic circuit diagram showing that a joining circuit is included in a hydraulic circuit shown in FIG. 1.

Based on FIG. 4, the following will explain a hydraulic circuit, like a hydraulic excavator, including the first structure (revolving super structure; reference sign 102 in FIG. 7) that is caused to swing by the electric motor 3 and the hydraulic motor 2 in cooperation and a second structure (boom; reference sign 105 in FIG. 7) that is caused to move up by a hydraulic actuator. The hydraulic circuit includes a joining circuit so as to be able to perform the combined operation of manipulating a plurality of driven bodies at the same time. In FIG. 4, the components regarding the controller 7 shown in FIG. 1 are omitted, and the same reference signs are used for the same components as in FIG. 1.

As shown in FIG. 4, a drive controller 50 includes the hydraulic motor 2 and electric motor 3 configured to cause the revolving super structure (first structure) to swing and also includes a hydraulic actuator 51 (boom cylinder 106 shown in FIG. 7) configured to cause the boom (second structure) to move up and down. In the case of this configuration, in addition to the first hydraulic pump 10 configured to drive the revolving super structure, a second hydraulic pump 52 configured to drive the hydraulic actuator 51 is provided. A solenoid-operated proportional reducing valve 43 is provided at a tilting angle adjusting port 42 configured to control the tilting angle of the second hydraulic pump 52. The second hydraulic pump 52 is connected to the hydraulic actuator 51 via a second control valve 53. By switching the second control valve 53, the hydraulic actuator 51 is caused to move up or down.

In addition, a second remote control valve 54 (boom remote controller) configured to manipulate the second control valve 53 for driving the hydraulic actuator 51 is provided. The second remote control valve 54 is manipulated to switch the second control valve 53.

In the circuit configured to perform the combined operation as above by the hydraulic motor 2 and electric motor 3 that cause the revolving super structure to swing and the hydraulic actuator 51 that causes the boom to move up and down, a joining valve 55 is provided on a downstream side of the above-described first control valve 14. The joining valve 55 is switched by manipulating the second remote control valve 54 (boom remote controller). When the joining valve 55 is switched by manipulating the second remote control valve 54, the operating oil ejected from the first hydraulic pump 10 is caused to join the operating oil ejected from the second hydraulic pump 52. Thus, the operation of the hydraulic actuator 51 can be assisted.

When the second remote control valve 54 is inclined in such a direction that a rod 61 of the hydraulic actuator 51 moves up, and moving-up control pressure reaches predetermined switching pressure, the joining valve 55 is switched to a joining side (right side shown in FIG. 4) by the control pressure acting on a pilot port 56 of the joining valve 55 from the second remote control valve 54. When switching the joining valve 55, a high-pressure selecting portion 58 selects high pressure that is the control pressure selected by a high-pressure selecting portion 57 provided at both ports of the first remote control valve 5 or the control pressure of the second remote control valve 54, and the tilting control of the first hydraulic pump 10 is performed. Since the second remote control valve 54 is manipulated more largely than the first remote control valve 5 in many cases, the tilting of the first hydraulic pump 10 is also controlled by the moving-up control pressure of the second remote control valve 54 in many cases. With this, the operating oil ejected from the first hydraulic pump 10 is supplied through the joining valve 55 to a joining passage 59 of the hydraulic actuator 51 to be caused to join the operating oil of the second hydraulic pump 52. A check valve 60 is provided on the joining passage 59 and prevents the operating oil from flowing backward from the hydraulic actuator 51 side toward the joining valve 55.

The solenoid-operated proportional reducing valve 43 of the second hydraulic pump 52 is controlled by the moving-up control pressure of the second remote control valve 54. With this, the flow rate of the operating oil supplied from the second hydraulic pump 52 through the second control valve 53 to the hydraulic actuator 51 corresponds to the manipulation amount of the second remote control valve 54.

Therefore, when the joining valve 55 is switched to the joining side, the first hydraulic pump 10 and the second hydraulic pump 52 are caused to have the same ejecting pressure. Then, the operating oil ejected from the first hydraulic pump 10 flows through the joining valve 55 and the joining passage 59 to join the operating oil supplied from the second hydraulic pump 52 to the hydraulic actuator 51, and the joined operating oil is supplied to the hydraulic actuator 51. With this, the hydraulic actuator 51 is caused to quickly move up by a high driving force.

The operating oil supplied to the hydraulic motor 2 through the first control valve 14 from the first hydraulic pump 10 whose tilting is controlled by the moving-up control pressure of the second remote control valve 54 as above is supplied through the first control valve 14 whose opening position is controlled by the control pressure output from the first remote control valve 5. With this, the operating oil corresponding to manipulation amount of the first remote control valve 5 is supplied to the hydraulic motor 2. To be specific, even in a case where the tilting of the first hydraulic pump 10 is controlled by the moving-up control pressure of the second remote control valve 54, the amount of operating oil supplied from the first hydraulic pump 10 to the hydraulic motor 2 is restricted by the first control valve 14, so that the amount of operating oil supplied to the hydraulic motor 2 can be caused to become an amount corresponding to the manipulation amount of the first remote control valve 5. Details of this control operation will be described below.

Figure 5:
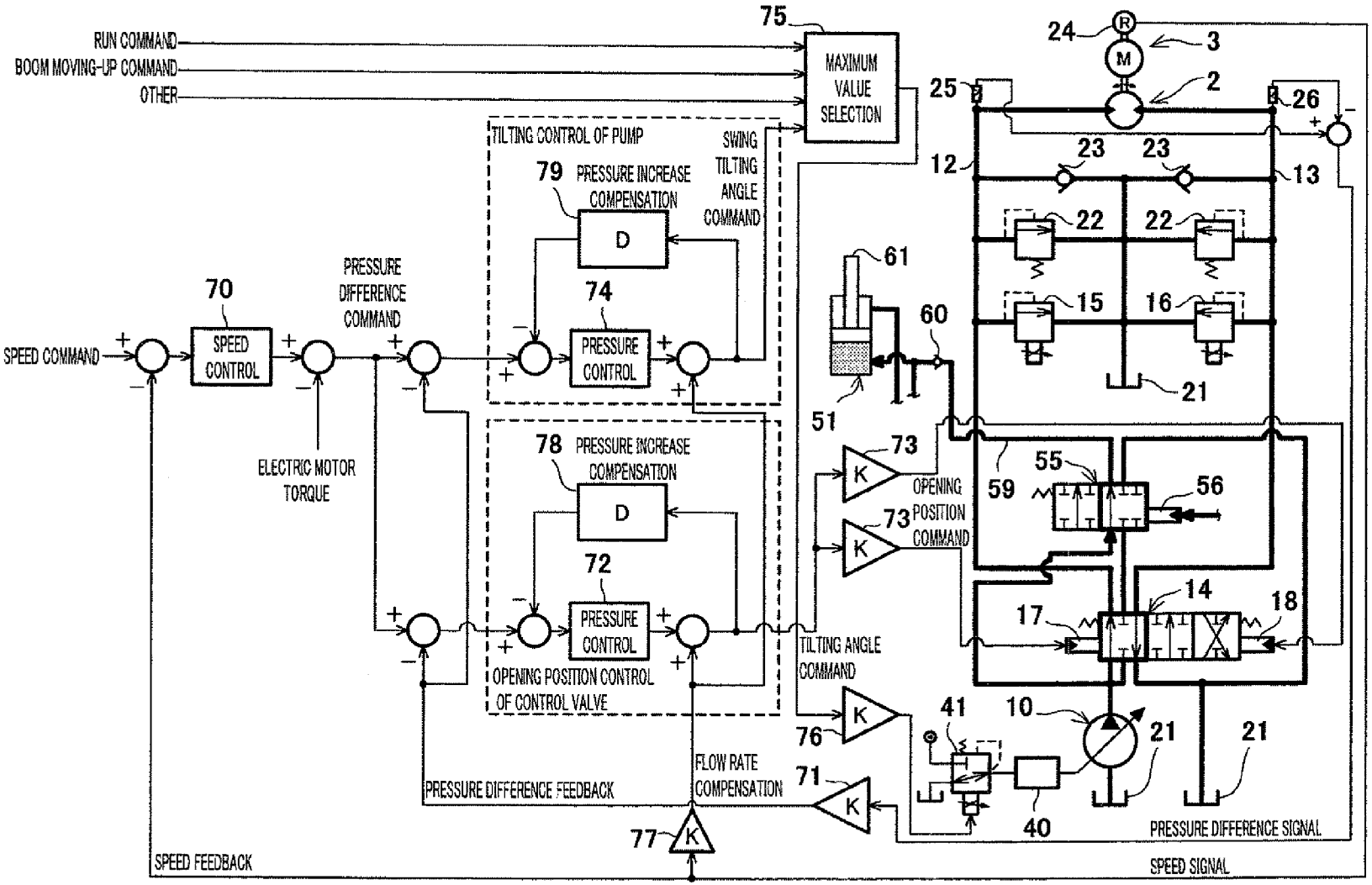
FIG. 5 is a hydraulic circuit diagram showing a control method of the drive controller according to Embodiment 1 of the present invention.

FIG. 5 is a hydraulic circuit diagram showing a method of controlling the first control valve 14 and the first hydraulic pump 10 by the drive controller 50 according to Embodiment 1 of the present invention. The same reference signs are used for the same components as in FIGS. 4 and 1. In the opening position control of the first control valve 14 and the tilting angle control of the first hydraulic pump 10, the actual rotation speed signal output from the rotation speed sensor 24 of the electric motor 3 is input as the speed feedback to the speed command output from the first remote control valve 5. Then, the obtained signal is subjected to a speed control 70. Thus, the feedback control with respect to the speed command is performed. Then, by subtracting from the obtained signal the torque which can be output by the electric motor 3, the pressure difference command is generated.

After that, a pressure difference signal based on an operating oil pressure difference of the pressure sensors 25 and 26 provided at the suction port and discharge port of the hydraulic motor 2 is input as the pressure difference feedback through a control gain 71 to the pressure difference command. Thus, the feedback control is performed. Then, based on the signal obtained after the feedback control, the opening position control of the first control valve 14 and the tilting control of the first hydraulic pump 10 are performed.

As the opening position control of the first control valve 14, a pressure difference deviation (difference between the pressure difference command and the pressure difference feedback) is subjected to a pressure control 72, and then a necessary pump oil amount calculated by a control gain 77 based on the actual rotation speed of the hydraulic motor 2 obtained from the signal of the rotation speed sensor 24 provided at the electric motor 3 is added to the manipulation amount of the opening position command. With this, the flow rate compensation is performed such that the opening position command corresponding to the latest actual rotation speed is output as a final command.

The pressure increase compensation is performed by providing a minor loop 78 between the opening position command having been subjected to the flow rate compensation and the pressure difference deviation, the minor loop 78 being configured to perform feedback of a difference of the opening position command of the first control valve 14. To be specific, the control calculation of a differential action (D operation) is performed with respect to the opening position command of the first control valve 14, and the signal obtained after this control calculation is fed back to the pressure difference deviation. Thus, the gain in the high frequency range can be reduced, and the stability of the pressure control can be improved by smoothing the opening position command.

Then, the signal having been subjected to the flow rate compensation and the pressure increase compensation is output as the opening position command through a control gain 73 to the pilot ports 17 and 18 of the first control valve 14. Thus, the opening position of the first control valve 14 is controlled. As above, in the present embodiment, a high-speed and stable control characteristic can be obtained by performing the flow rate compensation and the pressure increase compensation in the control of the opening position of the first control valve 14.

In addition, as described above, the opening position of the first control valve 14 is controlled by respectively providing the solenoid-operated proportional reducing valves 19 and 20 (FIG. 1) at the pilot ports 17 and 18 of the first control valve 14. Therefore, the necessary flow rate can be controlled with a high degree of accuracy. Thus, the energy efficiency is improved.

As the tilting control of the first hydraulic pump 10, the pressure difference deviation is subjected to a pressure control 74, and then a necessary pump oil amount calculated by the control gain 77 based on the actual rotation speed of the hydraulic motor 2 obtained from the signal of the rotation speed sensor 24 provided at the electric motor 3 is added to the swing tilting angle command having been subjected to the pressure control 74. With this, the flow rate compensation is performed such that the swing tilting angle command corresponding to the latest actual rotation speed is output as the final command.

Moreover, the pressure increase compensation is performed by providing a minor loop 79 between the swing tilting angle command having been subjected to the flow rate compensation and the pressure difference deviation, the minor loop 79 being configured to perform feedback of a difference of the swing tilting angle command. To be specific, the control calculation of the differential action (D operation) is performed with respect to the swing tilting angle command, and the signal obtained after this control calculation is fed back to the pressure difference deviation. Thus, the gain in the high frequency range is reduced. With this, the stability of the pressure control is improved by smoothing the swing tilting angle command.

Then, the swing tilting angle command having been subjected to the flow rate compensation and the pressure increase compensation is input to a maximum value selection 75 and compared with the other command (in this example, a run command, a boom moving-up command, or the like) in the operating machine. The signal selected by the maximum value selection 75 is output as the tilting angle command through a control gain 76 to the solenoid-operated proportional reducing valve 41 of the first hydraulic pump 10. Thus, the tilting angle of the first hydraulic pump 10 is controlled.

As above, in the present embodiment, a high-speed and stable control characteristic can be obtained by performing the flow rate compensation and the pressure increase compensation in the control of the opening position of the first control valve 14 and the control of the tilting angle of the first hydraulic pump 10. In addition, by controlling the opening position of the first control valve 14 and the tilting angle of the first hydraulic pump 10 as above, the operating oil, the amount of which is optimized based on the speed command output from the first remote control valve 5, the actual rotation speed of the hydraulic motor 2, and the pressure difference between the suction port and discharge port of the hydraulic motor 2, can be ejected from the first hydraulic pump 10. With this, at the time of the normal operation, the operating oil of the first hydraulic pump 10 is not discharged from the relief valves 22. Thus, the energy efficiency can be improved.

Further, in a case where the hydraulic actuator 51 is caused to move up by the second remote control valve 54 (FIG. 4) while the revolving super structure is swinging, the swing tilting angle command is set to a low level such that the operating oil, the amount of which is optimized for driving the hydraulic motor 2, is ejected. Therefore, the boom moving-up command (the moving-up control pressure of the second remote control valve 54) is selected in the maximum value selection 75. Then, the signal is output as the tilting angle command through the control gain 76 to the solenoid-operated proportional reducing valve 41 of the first hydraulic pump 10. Thus, the tilting angle of the first hydraulic pump 10 is controlled. With this, the operating oil corresponding to the boom moving-up command is ejected from the first hydraulic pump 10 to be supplied through the joining valve 55 to the hydraulic actuator 51.

In this case, while maintaining a state where the hydraulic actuator 51 can be driven by a high driving force by causing the operating oil of the first hydraulic pump 10 to join the operating oil of the second hydraulic pump 52, the operating oil, the amount of which is appropriate for the manipulation amount of the first remote control valve 5, can be supplied to the hydraulic motor 2, driven in cooperation with the electric motor 3, by controlling the opening position of the first control valve 14. With this, the driving of the boom by the hydraulic actuator 51 and the driving of the revolving super structure by the hydraulic motor 2 and the electric motor 3 can be efficiently performed.

In a case where only the swinging of the revolving super structure is performed without causing the boom to move up, a control operation may be performed, in which: without performing the opening position control of the first control valve 14, the opening position of the first control valve 14 is set to a maximum opening position such that the pressure loss is minimized; and the tilting control of the first hydraulic pump 10 is performed. As above, by switching the opening position control of the first control valve 14, the operation in which the energy loss is smaller can be performed.

Next, a drive control method of the operating machine by a drive controller 80 according to Embodiment 2 will be explained based on FIG. 6. In this example, the drive controller 80 compensates for the tilting angle command of the first hydraulic pump 10 by actual ejecting pressure of the second hydraulic pump 52. The same reference signs are used for the same components as in FIGS. 1, 4, and 5.

Figure 6:
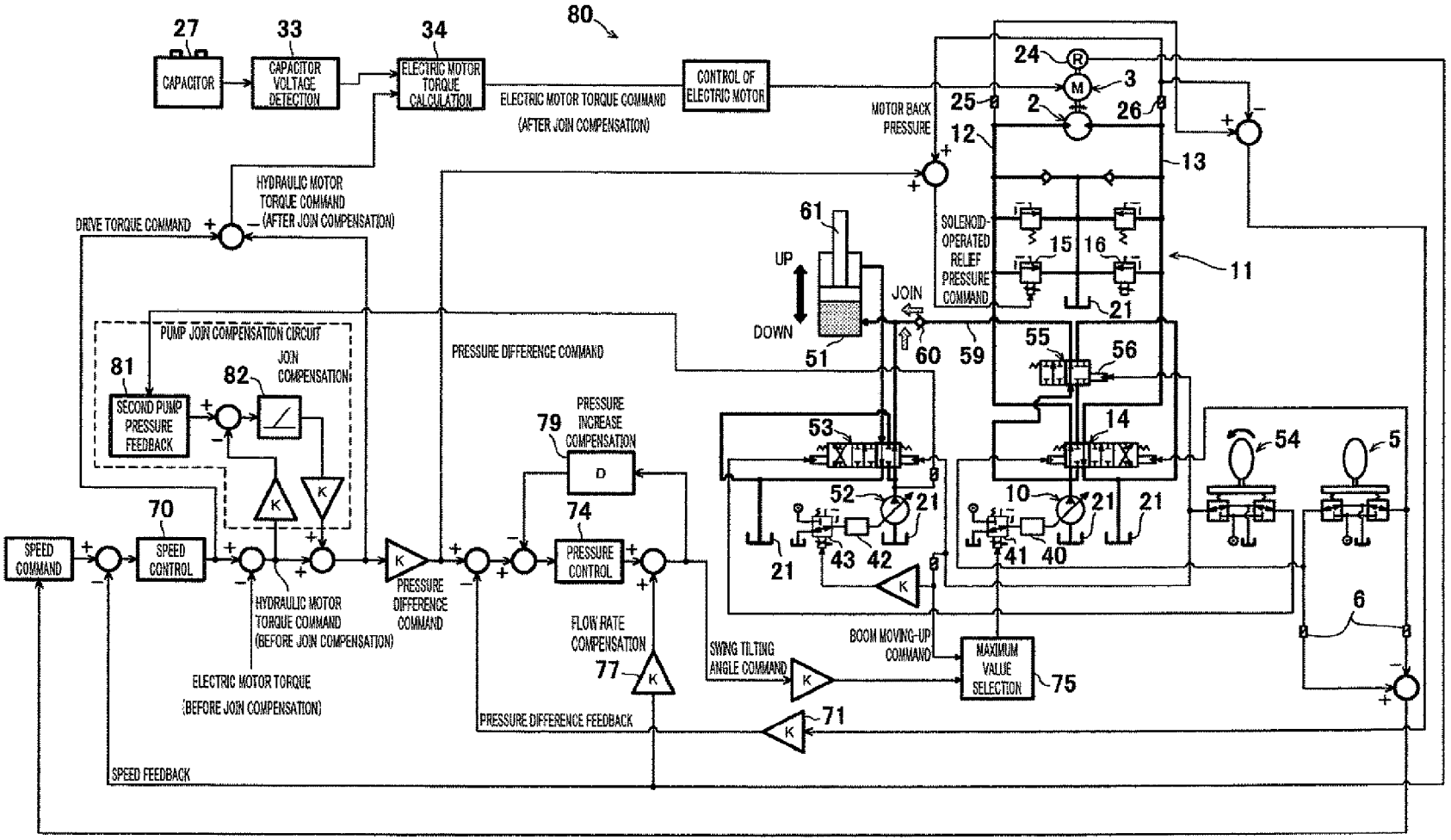
FIG. 6 is a hydraulic circuit diagram showing the control method of the drive controller according to Embodiment 2 of the present invention.

As shown in FIG. 6, in the present embodiment, the actual rotation speed signal output from the rotation speed sensor 24 of the electric motor 3 is input as the speed feedback to the speed command generated based on the pressure difference between the left and right ports of the first remote control valve 5, the pressure difference being detected by the pressure sensors 6. Then, the obtained signal is subjected to the speed control 70, and the speed feedback control with respect to the speed command is performed. After that, a hydraulic motor torque command (before join compensation) is generated by subtracting, from the obtained signal, torque (before the join compensation) that can be output by the electric motor 3.

Then, the actual ejecting pressure of the second hydraulic pump 52 as a second hydraulic pump pressure feedback 81 is fed back to the hydraulic motor torque command (before the join compensation). With this, the join compensation in which the hydraulic motor torque command (before the join compensation) is increased up to the actual ejecting pressure of the second hydraulic pump 52 is performed (when the join compensation is zero or less, it is cut by a join compensation limiter 82). With this, the hydraulic motor torque command (after the join compensation) is generated, and the pressure difference command is generated from the hydraulic motor torque command (after the join compensation) via the control gain.

After that, the pressure difference signal based on the operating oil pressure difference of the pressure sensors 25 and 26 is input as the pressure difference feedback through the control gain 71 to the pressure difference command. The pressure difference deviation (difference between the pressure difference command and the pressure difference feedback) is subjected to the pressure control 74, and then the necessary pump oil amount calculated by the control gain 77 based on the actual rotation speed of the hydraulic motor 2 obtained from the signal of the rotation speed sensor 24 provided at the electric motor 3 is added to the swing tilting angle command obtained by the pressure control 74. Thus, the flow rate compensation is performed. With this, the swing tilting angle command corresponding to the latest actual rotation speed is output as the final command.

In the present embodiment, the pressure increase compensation is performed by providing the minor loop 79 between the swing tilting angle command having been subjected to the flow rate compensation and the pressure difference deviation, the minor loop 79 being configured to perform feedback of a difference of the swing tilting angle command.

Then, the swing tilting angle command is input to the maximum value selection 75 and compared with the boom moving-up command (moving-up command of the hydraulic actuator 51) output from the second remote control valve 54. The swing tilting angle command input to the maximum value selection 75 is the swing tilting angle command compensated by the actual ejecting pressure of the second hydraulic pump 52 and is compared with the boom moving-up command (tilting angle command of the second hydraulic pump 52) output from the second remote control valve 54. In a case where the command after the join compensation is higher than the boom moving-up command of the second remote control valve 54, the swing tilting angle command after the join compensation is selected. In a case where the command after the join compensation is lower than the boom moving-up command of the second remote control valve 54, the boom moving-up command of the second remote control valve 54 is selected. Thus, the tilting angle of the first hydraulic pump 10 is controlled. The tilting angle of the second hydraulic pump 52 is controlled by the boom moving-up command output from the second remote control valve 54.

By the above control, the tilting angle command of the first hydraulic pump 10 is compensated by the ejecting pressure of the second hydraulic pump 52. Thus, the feedback control of the tilting angle command of the first hydraulic pump 10 can be properly performed in accordance with the actual ejecting pressure of the second hydraulic pump 52.

In the present embodiment, the pressure difference command after the join compensation is subjected to a motor back pressure feedback output from the pressure sensor 26 (right side in FIG. 6) provided on a back pressure side of the hydraulic motor 2, and a signal obtained by adding the motor back pressure feedback signal to the pressure difference command is used as a relief pressure command of the solenoid-operated relief valve 15 located on the upstream side of the hydraulic motor 2. With this, the control pressure of the solenoid-operated relief valve 15 can be prevented from being set to be lower than the pressure necessary for the system. The set value of the solenoid-operated relief valve 15 (16) can be adjusted by using the pressure difference command after the join compensation such that the operating oil ejected from the first hydraulic pump 10 is not discharged from the solenoid-operated relief valve 15 (16) of the hydraulic motor circuit 11 even in a case where the moving-up command of the second remote control valve 54 is higher than the swing tilting angle command after the join compensation, the boom moving-up command of the second remote control valve 54 is selected, and the tilting angle of the first hydraulic pump 10 is controlled. With this, the pressure of the operating oil for driving the hydraulic actuator 51 can be stably maintained in the hydraulic motor circuit 11.

In the present embodiment, in a case where the energy by which the electric motor 3 can be driven is being stored in the capacitor 27, an electric motor torque command is calculated by the electric motor torque calculation 34 based on, for example, the voltage detected by the voltage detection 33 of the capacitor 27 in order to compensate for the shortfall that is the torque obtained by subtracting the hydraulic motor torque command (after the join compensation) having been subjected to the join compensation from the drive torque command having been subjected to the speed control 70 and necessary to drive the revolving super structure. By this electric motor torque command, the electric motor 3 is controlled (FIG. 2) so as to compensate for the shortfall of the torque of the hydraulic motor 2. With this, in the operating machine including a plurality of structures driven by the plurality of hydraulic pumps 10 and 52, the stored electric energy is efficiently used in accordance with the drive torque of the hydraulic motor 2. Thus, the driving with high energy efficiency can be performed. In addition, the time for the swing operation can be shortened by a time corresponding to the assist amount of the electric motor 3. Thus, the pump loss can be reduced.

As explained above, according to the above drive control method, in order to compensate by the drive torque of the hydraulic motor 2 for the shortfall that is the torque obtained by subtracting the drive torque of the electric motor 3 from the torque necessary to drive the revolving super structure, only the oil, the amount of which is necessary for the swing movement of the hydraulic motor 2, is supplied by controlling the opening position of the first control valve 14 or the tilting angle of the hydraulic pump 10. Therefore, without using the relief valve as a torque control unit for the hydraulic motor 2, the energy loss can be reduced. Thus, the energy efficiency for driving the revolving super structure can be improved, and the fuel efficiency can be improved.

In the operating machine including a plurality of hydraulic pumps, even in a state where the operating oil supplied from the first hydraulic pump 10 is caused to join the operating oil supplied from the second hydraulic pump 52, the operating oil, the amount of which is appropriate for driving the hydraulic motor 2, can be supplied from the first hydraulic pump 10 to the hydraulic motor 2 such that the drive torque corresponding to the manipulation amount of the first remote control valve 5 is obtained. In addition, the stable driving of the revolving super structure (first structure) by the electric motor 3 and the hydraulic motor 2 and the driving of the boom (second structure) by the hydraulic actuator 51 driven by causing the operating oil of the first hydraulic pump 10 to join the operating oil of the second hydraulic pump 52 can be efficiently performed.

The substantially entire amount of inertial energy (rotational energy) of the revolving super structure is efficiently recovered as the electric energy by the regenerative action of the electric motor 3 at the time of the deceleration to be stored in the capacitor 27, and the stored electric energy is used at the time of the next acceleration of the revolving super structure. Therefore, the use efficiency of the energy improves, and the fuel efficiency of the operating machine also improves. In addition, the discharging of a greenhouse gas can be suppressed.

Further, in the above embodiment, the electric motor 3 is driven by preferentially utilizing the stored energy of the capacitor 27, and the hydraulic motor 2 compensates for the shortfall. Therefore, the quick acceleration can be realized, and the use efficiency of the stored energy can be improved.

Since the torque distribution of the hydraulic motor 2 can be adjusted by controlling the tilting angle of the first hydraulic pump 10 and the opening position of the first control valve 14, the switching from the electric motor 3 to the hydraulic motor 2 can be performed in a shockless manner.

The above embodiment has explained an example in which the electric motor 3 is driven by preferentially utilizing the stored energy of the capacitor 27, and the hydraulic motor 2 compensates for the shortfall of the torque. However, if the amount of stored energy of the capacitor 27 is small, the revolving super structure may be rotated only by the hydraulic motor 2 without using the electric motor 3, and the above embodiment is not necessarily limited to the configuration in which the electric motor 3 is preferentially used, and the hydraulic motor 2 compensates for the shortfall.

The above embodiment has explained an example in which the structures of the operating machine are the revolving super structure and boom of the hydraulic excavator. However, the above embodiment is applicable to the structures of the other operating machines, such as revolving super structures of cranes and carriers of wheel loaders, and the above embodiment is not limited.

Further, the above embodiment is just one example, and various modifications may be made within the spirit of the present invention. The present invention is not limited to the above embodiment.

INDUSTRIAL APPLICABILITY

The operating machine drive control method according to the present invention can be utilized in a heavy machinery, such as a hydraulic excavator or a hydraulic crane, that is, in an operating machine in which a hydraulic motor and an electric motor are provided in a drive system.

REFERENCE SIGNS LIST

1 drive controller
2 hydraulic motor (swing hydraulic motor)
3 electric motor
4 inclination handle
5 first remote control valve (swing remote controller)
6 pressure sensor
7 controller
8 first hydraulic pump
9 hydraulic motor circuit
12, 13 oil passage
14 first control valve
15, 16 solenoid-operated relief valve
17, 18 pilot port
19, 20 solenoid-operated proportional reducing valve
21 tank
22 relief valve
23 check valve
24 rotation speed sensor
25, 26 pressure sensor
27 capacitor
30 speed command calculation
31 acceleration rate calculation
32 acceleration torque calculation
33 capacitor voltage detection
34 electric motor torque calculation
35 pressure difference command calculation
36 pressure control
37 current command calculation
38 current control
39 electric power converter
40 tilting angle adjusting port
41 solenoid-operated proportional reducing valve
42 tilting angle adjusting port
43 solenoid-operated proportional reducing valve
50 drive controller
51 hydraulic actuator (boom cylinder)
52 second hydraulic pump
53 second control valve
54 second remote control valve (boom remote controller)
55 joining valve
56 pilot port
57 high-pressure selecting portion
58 high-pressure selecting portion
59 joining passage
60 check valve
61 rod
70 speed control
71 control gain (pressure difference feedback)
72 pressure control
73 control gain (opening position command)
74 pressure control
75 maximum value selection
76 control gain (tilting angle command)
77 control gain (flow rate compensation)
78, 79 minor loop
80 drive controller
81 second hydraulic pump pressure feedback
82 join compensation limiter
100 hydraulic excavator
101 base carrier
102 revolving super structure (first structure)
103 bucket
104 arm
105 boom (second structure)
106 boom cylinder

The invention claimed is:

1. A drive control method of an operating machine, the operating machine being configured to drive a structure by a hydraulic motor, and an electric motor configured to cooperate with the hydraulic motor, the hydraulic motor being configured to be driven by operating oil supplied from a hydraulic pump through a control valve, the hydraulic pump being configured to change an ejection flow rate by controlling of a tilting angle of the hydraulic pump, the control valve being configured to control a flow rate of the operating oil based on an opening position of the control valve, the drive control method comprising:

causing a speed command to generate an opening position command such that an amount of the operating oil is ejected, the speed command being generated based on a manipulation amount of a remote control valve configured to determine an operation amount of the structure, and being subjected to: (i) speed feedback control based on an actual rotation speed of the hydraulic motor, and (ii) pressure difference feedback control based on an operating oil pressure difference between a suction port and discharge port of the hydraulic motor, the amount of the operating oil being ejected is the amount necessary for the actual rotation speed of the hydraulic motor; and controlling an opening position of the control valve, such that a flow rate of the operating oil is adjusted based on the opening position of the control valve.

2. The drive control method according to claim 1, further comprising:

causing the opening position command to be subjected to flow rate compensation such that the operating oil is supplied in the amount necessary at the actual rotation speed of the hydraulic motor, the flow rate compensation being performed in such a manner that a speed signal generated based on the actual rotation speed is added through a control gain to a signal obtained by the pressure difference feedback control.

3. The drive control method according to claim 2, further comprising:

performing pressure increase compensation by providing a minor loop between (i) the opening position command having been subjected to the flow rate compensation, and (ii) a pressure difference command to which a pressure difference feedback signal is input, the minor loop being configured to perform feedback of a difference of the opening position command.

4. The drive control method according to claim 1, wherein:

the hydraulic pump is a first hydraulic pump;

the control valve is a first control valve;

the structure is a first structure;

in addition to the first structure, a second structure configured to be driven by the operating oil supplied from a second hydraulic pump through a second control valve is included in the operating machine; and the operating oil supplied from the first hydraulic pump is caused to join the operating oil used to drive the second structure, the drive control method further comprising:

causing the speed command to generate a tilting angle command of the hydraulic pump such that an amount of operating oil is ejected, the speed command being generated based on the manipulation amount of the remote control valve configured to determine the operation amount of the first structure, and being subjected to: (i) the speed feedback control based on the actual rotation speed of the hydraulic motor, and (ii) the pressure difference feedback control based on the operating oil pressure difference between the suction port and discharge port of the hydraulic motor, the amount of operating oil being ejected is the amount necessary at the actual rotation speed of the hydraulic motor;

causing the tilting angle command to be subjected to the flow rate compensation such that the operating oil is supplied in the amount necessary for the actual rotation speed of the hydraulic motor, the flow rate compensation being performed in such a manner that the speed signal generated based on the actual rotation speed is added through the control gain to the signal obtained by the pressure difference feedback control;

comparing a signal obtained by the flow rate compensation and the other command in the operating machine;

selecting a maximum value from the signal obtained by the flow rate compensation and the other command in the operating machine; and controlling tilting of the hydraulic pump by using a signal of the maximum value as the tilting angle command.

5. The drive control method according to claim 1, further comprising:

at the time of initial acceleration of the structure, generating the opening position command of the control valve such that a shortfall is compensated by drive torque of the hydraulic motor, the shortfall is defined as torque obtained by subtracting drive torque that is output by the electric motor, from torque necessary for the acceleration of the structure.

6. A drive control method of an operating machine configured to drive a first structure by a hydraulic motor and an electric motor configured to cooperate with the hydraulic motor, the hydraulic motor being configured to be driven by operating oil supplied from a first hydraulic pump through a first control valve, the first hydraulic pump being configured to be able to change an ejection flow rate by control of a tilting angle of the first hydraulic pump, wherein:

in addition to the first structure, a second structure configured to be driven by the operating oil supplied from a second hydraulic pump through a second control valve is included in the operating machine; and the operating oil of the first hydraulic pump is caused to join the operating oil used to drive the second structure, the method comprising:

causing a speed command, generated based on a manipulation amount of a remote control valve configured to determine an operation amount of the first structure, to be subjected to speed feedback control, performed based on an actual rotation speed of the hydraulic motor, second pump pressure feedback control, performed by feedback of actual ejecting pressure of the second hydraulic pump, and pressure difference feedback control, performed based on an operating oil pressure difference between a suction port and discharge port of the hydraulic motor, to generate a swing tilting angle command of the first hydraulic pump such that the operating oil, the amount of which is necessary at the actual rotation speed of the hydraulic motor, is ejected;

selecting a maximum value from the swing tilting angle command of the first hydraulic pump and a tilting angle command of the second hydraulic pump; and controlling the tilting angle of the first hydraulic pump.

7. The drive control method according to claim 6, wherein the second pump pressure feedback control is performed as join compensation in which: a hydraulic motor torque command is obtained by subtracting an electric motor torque from a drive torque command having been subjected to the speed feedback control; and the actual ejecting pressure of the second hydraulic pump is fed back to the hydraulic motor torque command.

8. The drive control method according to claim 7, comprising:

subtracting the hydraulic motor torque command having been subjected to the join compensation from the drive torque command having been subjected to the speed feedback control, to obtain a torque command difference; and calculating a necessary electric motor torque command from the torque command difference and energy, by which the electric motor is able to be driven, to compensate for a shortfall of the torque of the hydraulic motor by the electric motor.

9. The drive control method according to claim 7, comprising adding back pressure of the hydraulic motor to a pressure difference command of the first hydraulic pump generated based on the hydraulic motor torque command having been subjected to the join compensation, to obtain a relief pressure command of a hydraulic motor circuit; and setting the relief pressure command as relief pressure of a solenoid-operated relief valve in a circuit located upstream of the hydraulic motor.

10. The drive control method according to claim 6, comprising causing the swing tilting angle command of the first hydraulic pump to be subjected to flow rate compensation such that the operating oil, the amount of which is appropriate for the actual rotation speed of the hydraulic motor, is supplied, the flow rate compensation being performed in such a manner that a speed signal generated based on the actual rotation speed is added through a control gain to a signal obtained by the pressure difference feedback control.

11. The drive control method according to claim 10, comprising performing pressure increase compensation by providing a minor loop between the swing tilting angle command having been subjected to the flow rate compensation and a pressure difference command to which the pressure difference feedback signal is input, the minor loop being configured to perform feedback of a difference of the swing tilting angle command.

* * * * *